US005477925A

United States Patent [19]

Trahan et al.

[11] Patent Number: 5,477,925

[45] Date of Patent: Dec. 26, 1995

[54] METHOD FOR MULTI-LATERAL COMPLETION AND CEMENTING THE JUNCTURE WITH LATERAL WELLBORES

[75] Inventors: Kevin O. Trahan; Rodney D. Bennett; John L. Baugh, all of Houston, Tex.; Christiaan D. Krauss, Velserbroek, Netherlands

[73] Assignee: Baker Hughes Incorporated, Houston, Tex.

[21] Appl. No.: 351,576

[22] Filed: Dec. 6, 1994

[51] Int. Cl.[6] ..... E21B 7/04; E21B 33/14; E21B 29/06

[52] U.S. Cl. ..... 166/382; 166/50; 166/117.5; 166/285

[58] Field of Search ..... 166/382, 50, 384, 166/285, 289, 242, 387, 241.1, 117.5; 175/61, 79

[56] References Cited

U.S. PATENT DOCUMENTS

| | | | |
|---|---|---|---|
| 2,397,070 | 3/1946 | Zublin . | |
| 2,452,920 | 11/1948 | Gilbert . | |
| 2,797,893 | 7/1957 | McCune et al. . | |
| 2,804,926 | 9/1957 | Zublin | 166/50 |
| 2,858,107 | 10/1958 | Comerauer . | |
| 3,330,349 | 7/1967 | Owsley et al. . | |
| 4,396,075 | 8/1983 | Wood et al. | 175/79 |
| 4,402,551 | 9/1983 | Wood et al. | 299/5 |
| 4,415,205 | 11/1983 | Rehm et al. | 299/5 |
| 4,436,165 | 3/1984 | Emery | 175/61 |
| 4,444,276 | 4/1984 | Peterson, Jr. | 175/61 |
| 4,573,541 | 3/1986 | Josse et al. | 175/78 |
| 4,807,704 | 2/1989 | Hsu et al. | 166/313 |
| 5,289,876 | 3/1994 | Graham | 166/276 |
| 5,301,760 | 4/1994 | Graham | 175/61 |
| 5,318,122 | 6/1994 | Murray et al. | 166/313 |
| 5,337,808 | 8/1994 | Graham | 166/191 |

FOREIGN PATENT DOCUMENTS

40168/93 12/1993 Australia .

*Primary Examiner*—Stephen J. Novosad
*Attorney, Agent, or Firm*—Fishman, Dionne & Cantor

[57] ABSTRACT

The present invention relates to art improved method for multilateral completion and cementing (e.g. sealing) the juncture between primary and lateral wellbores. The completion method of the present invention addresses the issue of cementation and sealing of junctures between vertical and lateral wellbores. It is desirable to have the ability to re-enter each lateral wellbore as well as maintain the option to perform any function that could be done in a single wellbore. For this reason, cemented and sealed lateral wellbores are desirable so that normal isolation, stimulation or any other operation can be achieved. The method allows sealing and reworking of either wellbores with single laterals or multiple laterals and provides safe durable junctions therebetween. The method of this invention utilizes a "hook" liner hanger system.

23 Claims, 6 Drawing Sheets

METHOD FOR MULTI-LATERAL COMPLETION AND CEMENTING THE JUNCTURE WITH LATERAL WELLBORES

BACKGROUND OF THE INVENTION

This invention relates generally to the completion of wellbores. More particularly, this invention relates to new and improved methods and devices for completion of a branch wellbore extending laterally from a primary well which may be vertical, substantially vertical, inclined or even horizontal. This invention finds particular utility in the completion of multilateral wells, that is, downhole well environments where a plurality of discrete, spaced lateral wells extend from a common vertical wellbore.

Horizontal well drilling and production have been increasingly important to the oil industry in recent years. While horizontal wells have been known for many years, only relatively recently have such wells been determined to be a cost effective alternative (or at least companion) to conventional vertical well drilling. Although drilling a horizontal well costs substantially more than its vertical counterpart, a horizontal well frequently improves production by a factor of five, ten, or even twenty in naturally fractured reservoirs. Generally, projected productivity from a horizontal well must triple that of a vertical hole for horizontal drilling to be economical. This increased production minimizes the number of platforms, cutting investment and operational costs. Horizontal drilling makes reservoirs in urban areas, permafrost zones and deep offshore waters more accessible. Other applications for horizontal wells include periphery wells, thin reservoirs that would require too many vertical wells, and reservoirs with coning problems in which a horizontal well could be optimally distanced from the fluid contact.

Some horizontal wells contain additional wells extending laterally from the primary vertical wells. These additional lateral wells are sometimes referred to as drainholes and vertical wells containing more than one lateral well are referred to as multilateral wells. Multilateral wells are becoming increasingly important, both from the standpoint of new drilling operations and from the increasingly important standpoint of reworking existing wellbores including remedial and stimulation work.

As a result of the foregoing increased dependence on and importance of horizontal wells, horizontal well completion, and particularly multilateral well completion have posed important concerns and have provided (and continue to provide) a host of difficult problems to overcome. Lateral completion, particularly at the juncture between the vertical and lateral wellbore is extremely important in order to avoid collapse of the well in unconsolidated or weakly consolidated formations. Thus, open hole completions are limited to competent rock formations; and even then open hole completion is inadequate since there is no control or ability to re-access (or re-enter the lateral) or to isolate production zones within the well. Coupled with this need to complete lateral wells is the growing desire to maintain the size of the wellbore in the lateral well as close as possible to the size of the primary vertical wellbore for ease of drilling and completion.

Conventionally, horizontal wells have been completed using either slotted liner completion, external casing packers (ECP's) or cementing techniques. The primary purpose of inserting a slotted liner in a horizontal well is to guard against hole collapse. Additionally, a liner provides a convenient path to insert various tools such as coiled tubing in a horizontal well. Three types of liners have been used namely (1) perforated liners, where holes are drilled in the liner, (2) slotted liners, where slots of various width and depth are milled along the liner length, and (3) prepacked liners.

Slotted liners provide limited sand control through selection of hole sizes and slot width sizes. However, these liners are susceptible to plugging. In unconsolidated formations, wire wrapped slotted liners have been used to control sand production. Gravel packing may also be used for sand control in a horizontal well. The main disadvantage of a slotted liner is that effective well stimulation can be difficult because of the open annular space between the liner and the well. Similarly, selective production (e.g., zone isolation) is difficult.

Another option is a liner with partial isolations. External casing packers (ECPs) have been installed outside the slotted liner to divide a long horizontal well bore into several small sections. This method provides limited zone isolation, which can be used for stimulation or production control along the well length. However, ECP's are also associated with certain drawbacks and deficiencies. For example, normal horizontal wells are not truly horizontal over their entire length, rather they have many bends and curves. In a hole with several bends it may be difficult to insert a liner with several external casing packers.

Finally, it is possible to cement and perforate medium and long radius wells are shown, for example, in U.S. Pat. No. 4,436,165.

While sealing the juncture between a vertical and lateral well is of importance in both horizontal and multilateral wells, re-entry and zone isolation is of particular importance and pose particularly difficult problems in multilateral well completions. Re-entering lateral wells is necessary to perform completion work, additional drilling and/or remedial and stimulation work. Isolating a lateral well from other lateral branches is necessary to prevent migration of fluids and to comply with completion practices and regulations regarding the separate production of different production zones. Zonal isolation may also be needed if the borehole drifts in and out of the target reservoir because of insufficient geological knowledge or poor directional control; and because of pressure differentials in vertically displaced strata as will be discussed below.

When horizontal boreholes are drilled in naturally fractured reservoirs, zonal isolation is seen as desirable. Initial pressure in naturally fractured formations may vary from one fracture to the next, as may the hydrocarbon gravity and likelihood of coning. Allowing them to produce together permits crossflow between fractures and a single fracture with early water breakthrough jeopardizes the entire well's production.

As mentioned above, initially horizontal wells were completed with uncemented slotted liners unless the formation was strong enough for an open hole completion. Both methods make it difficult to determine producing zones and, if problems develop, practically impossible to selectively treat the right zone. Today, zone isolation is achieved using either external casing packers on slotted or perforated liners or by conventional cementing and perforating.

The problem of lateral wellbore (and particularly multilateral wellbore) completion has been recognized for many years as reflected in the patent literature. For example, U.S. Pat. No. 4,807,704 discloses a system for completing multiple lateral wellbores using a dual packer and a deflective guide member. U.S. Pat. No. 2,797,893 discloses a method for completing lateral wells using a flexible liner and deflecting tool. U.S. Pat. No. 2,397,070 similarly describes lateral wellbore completion using flexible casing together with a closure shield for closing off the lateral. In U.S. Pat. No. 2,858,107, a removable whipstock assembly provides a means for locating (e.g., re-entry) a lateral subsequent to completion thereof. U.S. Pat. No. 3,330,349 discloses a mandrel for guiding and completing multiple horizontal wells. U.S. Pat. No. 5,318,122, which is assigned to the assignee hereof and incorporated herein by reference, discloses deformable devices that selectively seal the juncture between the vertical and lateral wells using an inflatable mold which utilizes a hardenable liquid to form a seal, expandable memory metal devices or other devices for plastically deforming a sealing material. U.S. Pat. Nos. 4,396,075; 4,415,205; 4,444,276 and 4,573,541 all relate generally to methods and devices for multilateral completion using a template or tube guide head. Other patents and patent applications of general interest in the field of horizontal well completion include U.S. Pat. Nos. 2,452,920, 4,402,551, 5,289,876, 5,301,760, 5,337,808, Australian patent application 40168/93, U.S. application Ser. No. 08/306,497 filed Sep. 15, 1994 which is assigned to the assignee hereof and incorporated herein by reference, and U.S. Ser. No. 08/188,998 filed Jan. 26, 1994, which is also commonly assigned and incorporated herein by reference.

Notwithstanding the above-described attempts at obtaining cost effective and workable lateral well completions, there continues to be a need for new and improved methods and devices for providing such completions, particularly sealing between the juncture of vertical and lateral wells, the ability to re-enter lateral wells (particularly in multilateral systems) and achieving zone isolation between respective lateral wells in a multilateral well system.

SUMMARY OF THE INVENTION

The above-discussed and other drawbacks and deficiencies of the prior art are overcome or alleviated by the method and device of the present invention for completion of lateral wells and more particularly for the completion of multilateral wells. In accordance with aforementioned U.S. Pat. No. 5,318,122, a plurality of methods and devices were provided for solving important and serious problems posed by lateral (and especially multilateral) completion including:

1. Methods and devices for sealing the junction between a vertical and lateral well.
2. Methods and devices for re-entering selected lateral wells to perform completion work, additional drilling, or remedial and stimulation work.
3. Methods and devices for isolating a lateral well from other lateral branches in a multilateral well so as to prevent migration of fluids and to comply with good completion practices and regulations regarding the separate production of different production zones.

In accordance with the present invention, still another improved method relating to multilateral completion and cementing (e.g. sealing) the juncture with lateral wellbores is presented. The completion method of the present invention addresses the issue of creating a window in the vertical hole, drilling a lateral wellbore and then sealing the juncture between the lateral and vertical wellbores to have the ability to re-enter each lateral wellbore as well as to maintain the option to perform any function that could be done in a single wellbore. For this reason, cemented lateral wellbores are desirable so that normal isolation, stimulation or any other operation can be achieved.

In accordance with the method of the present invention, prior to running in a novel "hook" liner system described hereinafter, a standard whipstock is used to mill out a window in the side of the casing of the vertical wellbore at the location where it is desired to drill a lateral wellbore. This is done by known methods. The lateral wellbore is then drilled by known methods to the total depth desired. Alternatively, the casing could include a pre-formed window. In addition, the lateral may have been previously formed therefore precluding the need for the steps of drilling the lateral wellbore.

The "hook" liner hanger system in accordance with this invention includes a "hook" and is run into the wellbore and then through the aforementioned milled window by known standard methods. Entering the lateral hole with the bottom of the "hook" liner hanger system is accomplished by using known standard orientation methods, or by utilizing a known bent sub. The "hook" liner hanger system is run into the lateral wellbore until the "hook" hanger locates on the milled window in the main vertical wellbore. Inside the "hook" liner hanger system is a tail pipe assembly with adjustable opposing swab cups. The tail pipe assembly is capable of carrying liquid cement or other fluids as required to inflate external casing packers or other devices as required. The end of the "hook" hanger liner is then plugged to allow the hydraulic set hanger to set by means of applied pressure. An external casing packer located near the end of the "hook" liner hanger system is then inflated to seal the lateral wellbore annular space just below the cementing valve of the "hook" liner hanger system. Opposing "swab-cups" are used to direct fluid to inflate the external casing packer.

Once the inflatable external casing packer is set, the opposing "swab cups" are moved up hole in the lateral wellbore until the "swab cups" straddle the ports (holes) in a cementing valve. Pressure is then applied in a known manner to open the cementing valve and then cement is pumped in to fill the area of the annular space extending from the top of the inflatable external casing packer up to the milled window at the intersection of the primary wellbore and the lateral wellbore. In accordance with an important feature of this invention, the "hook" liner hanger system preferably has a premilled window for allowance of vertical reentry into the primary wellbore below the juncture of the lateral wellbore and the primary wellbore.

Next, the external casing packer that is located up hole in the primary wellbore above the junction of the primary wellbore and lateral wellbore discussed above is set using known mechanical hydraulic or other known methods. The tailpipe assembly string is then withdrawn high enough to allow the end of the tailpipe assembly string to be pulled from the lateral wellbore and then lowered into the main wellbore through the premilled window of the "hook" liner hanger system.

The end (or bottom) of the tailpipe assembly string is then lowered down into the main wellbore until that bottom is close to the whipstock packer which has been left in the main wellbore below the juncture of the main wellbore and lateral wellbore during the entire operation to prevent cement and other debris from falling below the whipstock packer into the main wellbore. Of course, this whipstock packer has preferably been plugged by known means. Reverse circulatory or other known means can be used to clean out any excess cement or other debris that may have fallen on top of the whipstock packer when the cement was pumped out of the cementing valve in the cementing operation.

The above-discussed and other features and advantages of the present invention will be appreciated to those skilled in the art from the following detailed description and drawings.

BRIEF DESCRIPTION OF THE DRAWINGS

Referring now to the drawings, wherein like elements are numbered alike in the several FIGURES.

DESCRIPTION OF THE PREFERRED EMBODIMENT

In accordance with the present invention, a method and device for completing lateral, branch or horizontal wells which extend from a single primary wellbore, and more particularly for completing multiple wells extending from a single generally vertical wellbore (multilaterals) is described. It will be appreciated that although the terms primary, vertical, deviated, horizontal, branch and lateral are used herein for convenience, those skilled in the art will recognize that the devices and methods of the present invention may be employed with respect to wells which extend in directions other than generally vertical or horizontal. For example, the primary or parent wellbore may be vertical, inclined or even horizontal. Therefore, in general, the substantially vertical well will sometimes be referred to as the primary well and the wellbores which extend laterally or generally laterally from the primary wellbore may be referred to as the branch wellbores.

This invention discloses a preferred method of drilling, cementing and completing lateral wellbores extending from a parent or primary wellbore.

Figure 1:
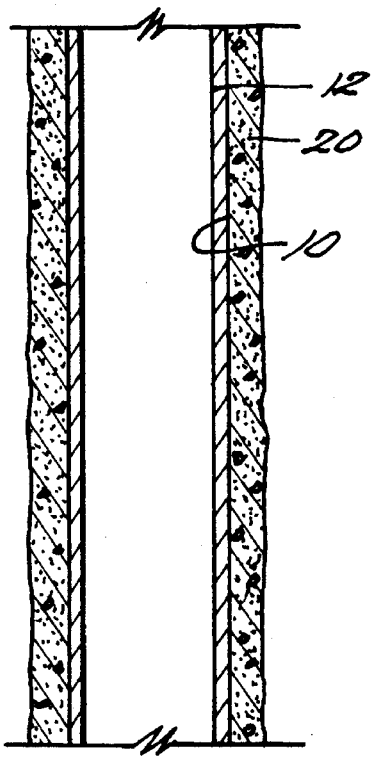
FIG. 1 is a cross-sectional elevation view of a cased borehole.

Referring first to FIG. 1, a cased borehole is shown comprising a primary or vertical wellbore 10 which may have been drilled previously or is initially drilled. Next, in a conventional manner, a well casing 12 is set and/or cemented in place in a conventional manner using cement 20.

Figure 2:
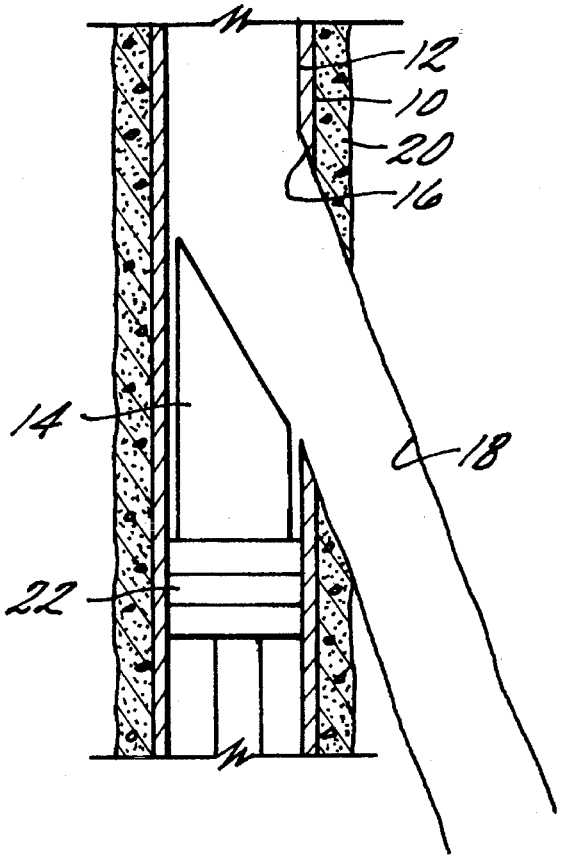
FIG. 2 is a cross-sectional elevation view of the cased borehole of FIG. 1 subsequent to milling of a window in the casing and the drilling of a lateral borehole.

Referring now to FIG. 2, a standard retrievable whipstock 14 and whipstock packer 22 are positioned in primary wellbore 10 and a known method is used to mill out a window 16 in casing 12 and cement 20 where it is desired to drill a lateral wellbore 18. Lateral wellbore 18 is then drilled to the desired depth by known methods. After the drilling of lateral wellbore 18 is completed, the drilling string (not shown) is withdrawn from lateral wellbore 18 and primary wellbore 10. In addition, the retrievable whipstock is withdrawn leaving behind whipstock packer 22. Alternatively, the casing could include a pre-formed window. In addition, the lateral may have been previously formed therefore precluding the need for the step of drilling the lateral wellbore.

Figure 3:
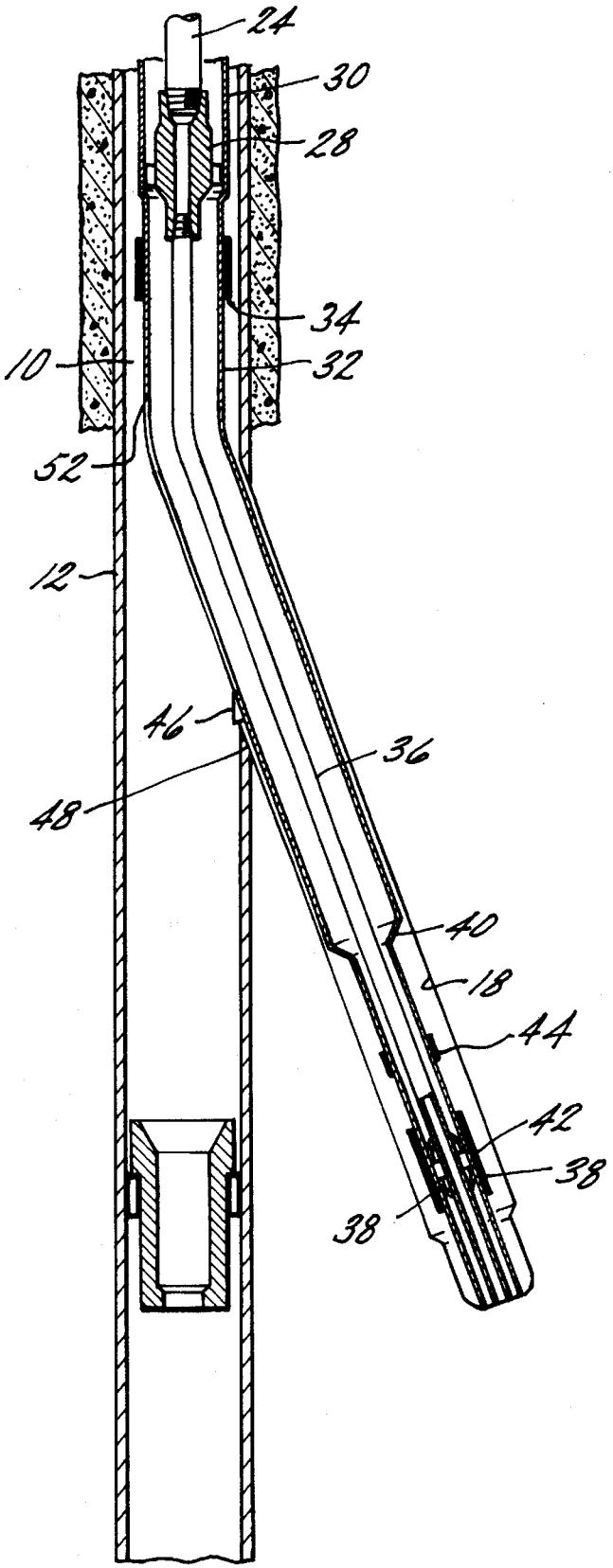
FIGS. 3–6 are sequential cross-sectional elevation views depicting the completion and cementing of the lateral borehole of FIG. 2.

Referring to FIG. 3, the following equipment is installed on the end of a section of drill pipe 24 to replace the drilling equipment that was used to drill lateral wellbore 18. First, a liner running tool 28 together with a liner setting sleeve with tieback extension 30 and liner sleeve 32 is mounted to drillpipe 24. Attached to the liner sleeve 32 near the liner running tool 28 is an external casing packer 34. External casing packer 34 remains in the main borehole 10.

Attached to the liner running tool 28 inside the liner sleeve 32 is a tail pipe 36 which has movable opposing swab cups 38 attached to tail pipe 36. A cross-over 40 which allows the rest of liner 32 to be a smaller diameter is located about ⅔ of the length along line 32. Also, near the end of the tailpipe 36 there is an external casing packer 42 which can be used to seal the toroidal space between liner sleeve 32 and lateral wellbore 18. A cementing valve 44 is located on liner sleeve 32 just above external casing packer 42.

Figure 7:
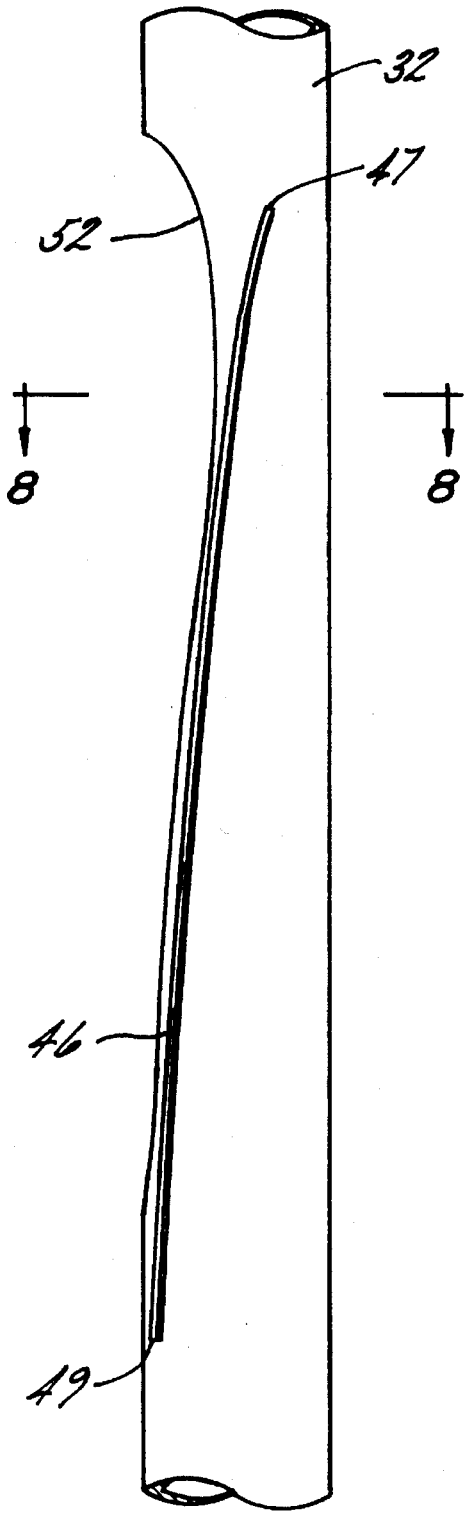
FIG. 7 is a longitudinal elevation view of the completion assembly used in FIGS. 3–6 and particularly depicting the "hook" liner hanger assembly.
Figure 8:
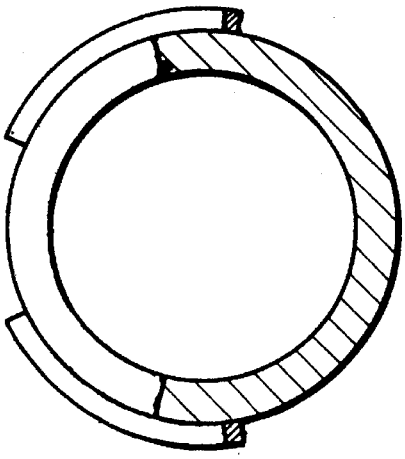
FIG. 8 is a cross-sectional elevation view along the line 8—8 of FIG. 7.

Below external casing packer 34 is a premilled window 52 in liner casing 32 which allows for re-entry into the primary borehole 10 after completion of the junction between lateral borehole 18 and primary borehole 10. The "hook" 46 on liner 32 constitutes an important feature of this invention and is shown in detail in FIGS. 7 and 8. Hook 46 comprises a pair of longitudinal lateral extensions 46, 46' welded or otherwise attached to opposed sides of line 32. Lips 46, 46' could also be machined out of a larger piece of raw material using known milling techniques. Each extension 46, 46' preferably has a rectangular cross-section and is positioned on the cylindrical outer surface of liner 32 in a substantially diagonal line covering in the range of about 5° to about 180° (from beginning 47 to end 49) of cylindrical liner 32. It will be appreciated that the oblong pattern defined by the two cooperating lips 46, 46' comprising the hook in effect match the oblong opening defined by milled window 16. As will be discussed in detail below, the "hook" 46 has three primary functions including:

(1) acting as a stop to preclude the liner 32 from exiting the window 16;

(2) hanging the weight of both liner 32 and any induced or other associated loads; and (3) channeling the cement (used for cementing liner 32) to the proper areas.

Regarding item (1), the hook 46 will stop the hanger liner 32 from exiting the window 16 because it gives the hanger liner 32 an effective outside diameter larger than that of window 16. Regarding item (2), because the hook 46, 46' is approximately the length of window 16, hook 46, 46' will distribute the liner load and other associated loads over a large area. This ability to distribute the liner load and other associated loads over large areas will allow the present .invention to have a high hanging capacity. Finally, regarding item (3), it will be appreciated that the liner body will sit at the lowest point possible in window 16. This will provide an extremely small flow path between the liner hanger 32 and the window 16 at this point. A small flow path is also expected at any point in which the "hook" 46 contacts the window 16. Because flow takes the path of least resistance, the cement will be channeled to the top of the window. This will provide an acceptable cement job around the entire intersection of lateral.

Figure 4:
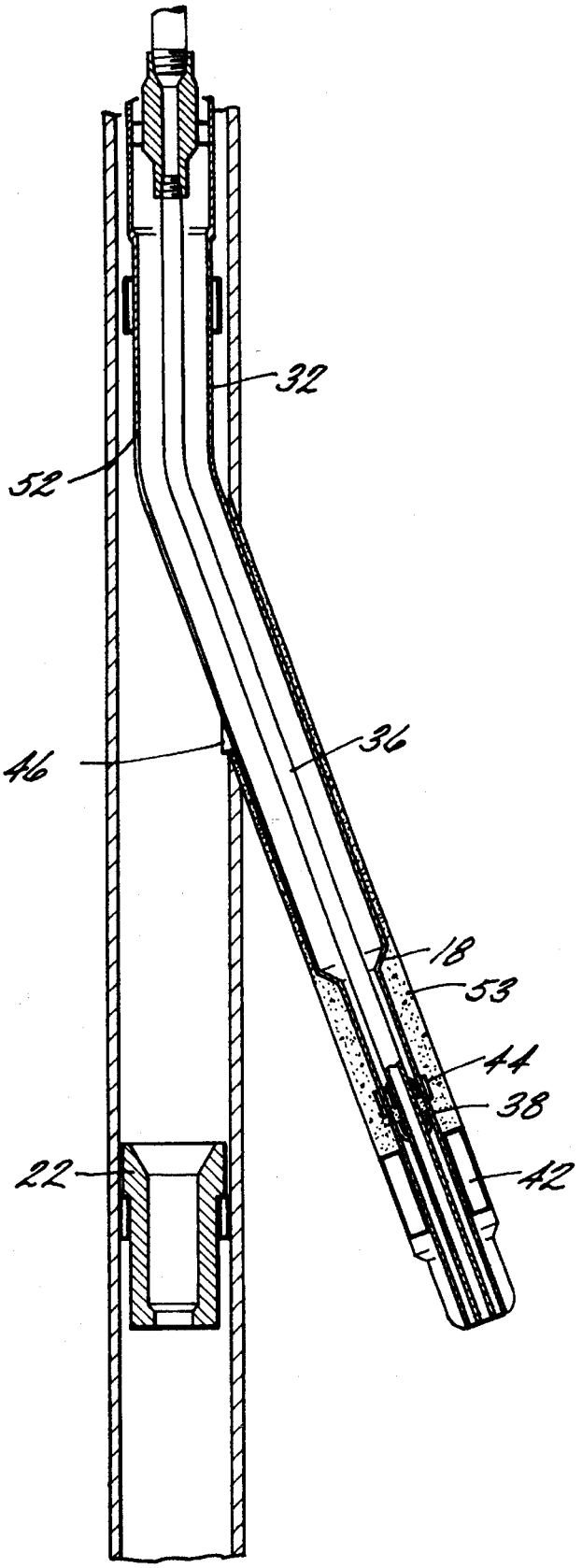

The above-described "hook" liner hanger system above-described (comprised of liner sleeve 32, tailpipe 36 and associated components, all of which are run in on drillstring 24 using liner running tool 28) is run into the primary borehole 10 using standard known methods. Standard known orientation methods are also used to locate and enter the lateral borehole 18 with the "hook" liner system. Alternately, a known bent sub may be used for this orientation operation. The "hook" liner system is run into the primary wellbore and lateral wellbore until the "hook" hanger 46 of the "hook" liner system locates on the bottom edge 48 of window 16 of main wellbore 10. The liner sleeve 32 is then plugged by known methods to allow the "hook" hanger 46 to be set in place with applied pressure and at the same time inflate external casing packer 42 so it seals the lateral wellbore 18. The opposing swab cups 38 are used to direct the fluid into the inflatable external casing packer 42 and to inflate the packer as shown in FIG. 4. The liner setting sleeve 30 is released from the liner 32 either by applied pressure or by right hand rotation of the run-in string.

Still referring to FIG. 4, once the inflatable external packer 42 is set, the opposing swab cups 38 are moved uphole until the swab cups 38 straddle the ports (holes) in the cementing valve 44. Pressure is applied in a known manner to open the cementing valve and cement or the like 53 (of any known or suitable composition) is pumped into the annular space 50 between the liner 32 and the sides of the lateral borehole 18. The area filled with cement 50 extends from the top of the inflatable external casing packer 42 up to the milled window 16 located at the intersection of lateral borehole 18 and primary borehole 10.

Figure 5:
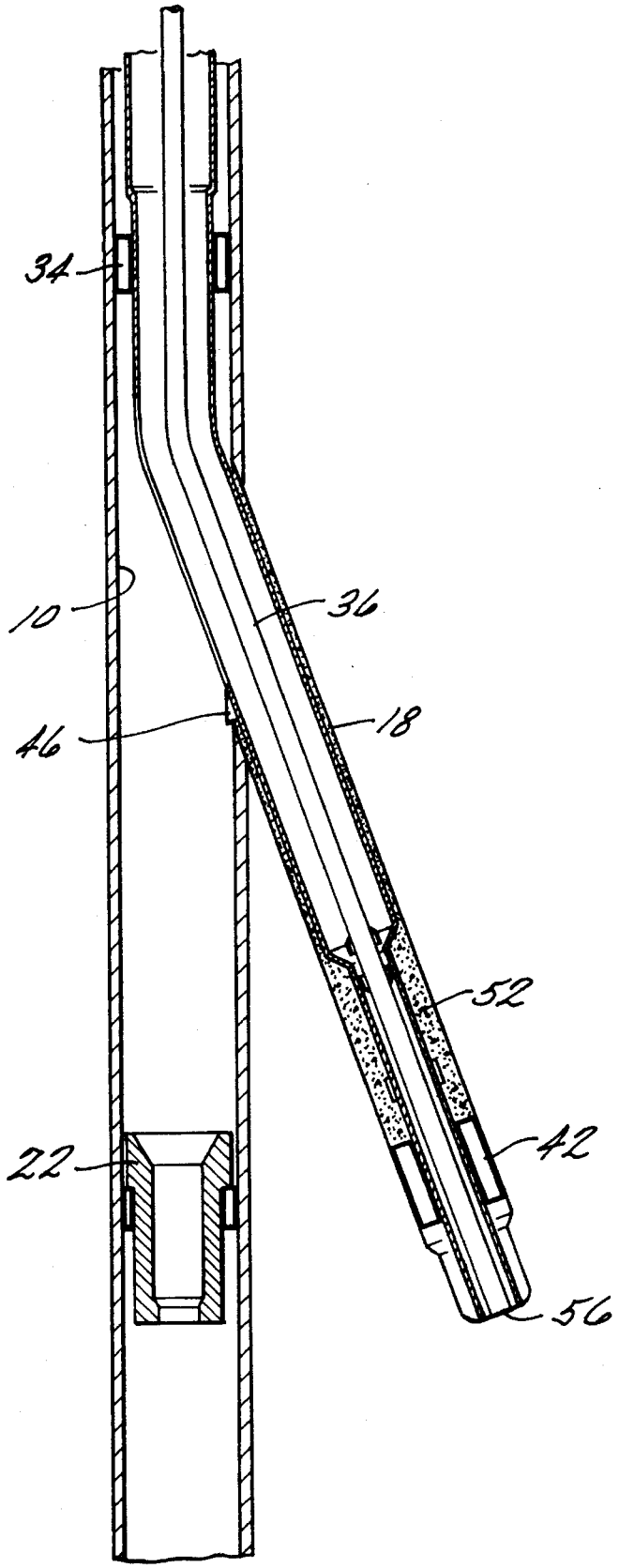
Figure 6:
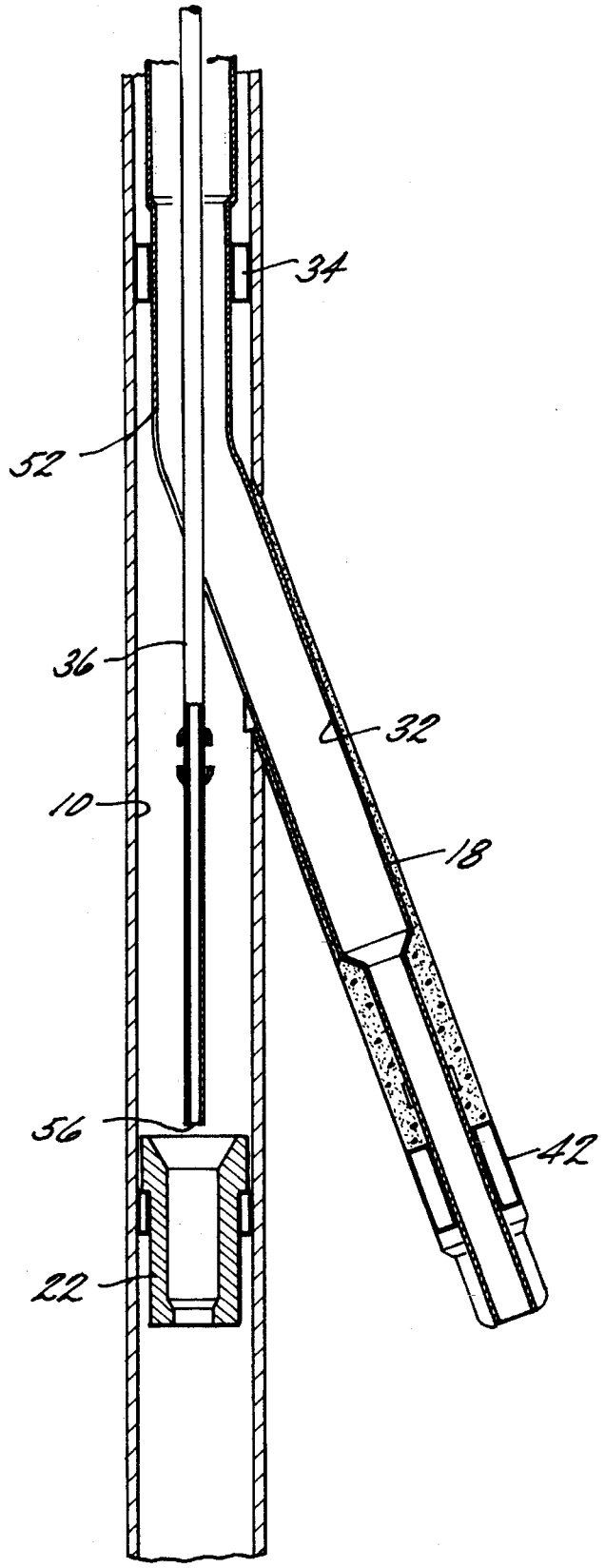

Turning now to FIG. 5, the external casing (liner) packer 34 is now set and inflated in place in primary borehole 10 using any number of known mechanical, hydraulic or other methods. The tailpipe string 36 is then picked uphole far enough to allow the end 56 of the tailpipe 36 to be pulled out of the lateral wellbore 18 and then lowered downhole into primary wellbore 10 as shown in FIG. 6.

The tailpipe 36 is then lowered downhole into the primary wellbore 10 so that the end 56 of tailpipe 36 is close to the top of whipstock packer 22. Reverse circulating can now be used to clean out any excess cement or other debris that may have fallen on top of the whipstock packer 22 when the cement was pumped out of the cementing valve or debris from any of the previously discussed operations. As a result of the above, the ability is maintained to perform any function that could be done in a single wellbore such as zonal isolation, stimulation or any other desired function.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A method for completing a primary wellbore having a first window therethrough and at least one lateral wellbore extending from said first window, comprising the steps of:

a) delivering a liner assembly into said primary wellbore and said lateral wellbore, said liner assembly including a hook hanger to engage said first window and said liner assembly including a second window therethrough for permitting passage from said liner assembly to said primary wellbore;

b) setting said hook hanger onto said first window; and c) delivering to the lateral wellbore a cementing assembly wherein cement is delivered to an annulus defined by a space between said assembly liner and said lateral wellbore at the junction of said primary wellbore and said lateral wellbore.

2. The method of claim 1 wherein said liner assembly includes a cementing valve and wherein:

said cementing valve includes cement delivery structure having opposing swab cup means having a flow opening therethrough wherein cement from said delivery structure flows through said flow opening when in line with said cementing valve of said liner assembly.

3. A method for cementing a multilateral wellbore as claimed in claim 2 including a first inflatable packer on said liner assembly and positioned in said lateral wellbore and wherein:

the annulus filled with cement is between the top of said inflatable packer and the junction of said primary wellbore.

4. A method for cementing a multilateral wellbore as claimed in claim 1 wherein said liner assembly is maintained in a predetermined position within the lateral wellbore by an external casing packer.

5. A method for cementing a multilateral wellbore as claimed in claim 4 wherein the external casing packer is inflated by a fluid delivered down hole by a work string.

6. The method of claim 1 wherein said primary borehole includes a casing and including the step of:

forming said first window in said casing at the site of the intersection between said primary wellbore and a lateral wellbore formed or to be formed.

7. The method of claim 6 including the steps of:

drilling a primary wellbore;

installing a casing in said primary wellbore; and cementing the annular space between said casing and said primary wellbore.

8. The method of claim 6 including the steps of:

locating the location downhole where it is desired to locate said first window for drilling a lateral wellbore; and milling said first window at said location through said casing for the purposes of drilling said lateral wellbore.

9. The method of claim 8 including the step of:

drilling a lateral wellbore at said first window.

10. The method of claim 1 including:

positioning an upper external packer in the primary wellbore to support a portion of the said liner assembly in said primary wellbore.

11. The method of claim 1 including:

using a clean out device to clean out excess cement and debris from said primary wellbore.

12. The method of claim 1 wherein said hook hanger comprises:

at least one longitudinal lip extending radially from said liner assembly and shaped to engage said first window.

13. The method of claim 12 including:

at least two longitudinal lips having a shape substantially commensurate with the shape of a portion of said first window.

14. A method for completing a primary wellbore having a first window therethrough and at least one lateral wellbore extending from said first window, comprising the steps of:

a) delivering a liner assembly into said primary wellbore and said lateral wellbore, said liner assembly including a hook hanger to engage said first window;

b) setting said hook hanger onto said first window;

c) delivering cement to an annulus defined by a space between said liner assembly and said lateral wellbore at the junction of said primary wellbore and said lateral wellbore.

15. The method of claim 14 wherein said hook hanger comprises:

at least one longitudinal lip extending radially from said liner assembly and shaped to engage said first window.

16. The method of claim 15 including:

at least two longitudinal lips having a shape substantially commensurate with the shape of a portion of said first window.

17. A completed wellbore having a primary wellbore with a first window therethrough and at least one lateral wellbore extending from said first window, comprising:

a liner assembly extending from said primary wellbore into said lateral wellbore, said liner assembly including a hook hanger engaged to said first window; and cement in an annulus defined by a space between said liner assembly and said lateral wellbore at the junction of said primary wellbore and said lateral wellbore.

18. The completed wellbore of claim 17 including:

a second window in said liner assembly for permitting passage from said liner assembly to said primary wellbore.

19. The completed wellbore of claim 18 wherein:

said second window is initially formed on the surface.

20. The completed wellbore of claim 17 including:

an upper packer for supporting said liner assembly in said primary wellbore; and a lower packer for supporting said liner assembly in said lateral wellbore.

21. The completed wellbore of claim 20 including:

a second window in said liner assembly for permitting passage from said liner assembly to said primary wellbore.

22. The completed wellbore of claim 18 wherein said hook hanger comprises:

at least one longitudinal lip extending radially from said liner assembly and shaped to engage said first window.

23. The completed wellbore of claim 22 including:

at least two longitudinal lips having a shape substantially commensurate with the shape of a portion of said first window.

* * * * *